US007556102B2

(12) United States Patent
Gomez

(10) Patent No.: US 7,556,102 B2
(45) Date of Patent: Jul. 7, 2009

(54) HIGH DIFFERENTIAL SHIFTING TOOL

(75) Inventor: Alfredo Gomez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/948,008

(22) Filed: Nov. 30, 2007

(65) Prior Publication Data

US 2009/0139726 A1 Jun. 4, 2009

(51) Int. Cl.
*E21B 34/06* (2006.01)
*E21B 43/00* (2006.01)

(52) U.S. Cl. ..... 166/373; 166/332.4; 166/334.4; 166/386; 166/332.1; 166/334.1

(58) Field of Classification Search ..... 166/373, 166/332.4, 332.5, 386, 334.4, 332.1, 334.1
See application file for complete search history.

(56) References Cited

U.S. PATENT DOCUMENTS 3,606,926 A * 9/1971 Schwegman ..... 166/383
4,928,772 A 5/1990 Hopmann ..... 166/386
5,156,220 A 10/1992 Forehand et al. ..... 166/386
5,309,993 A 5/1994 Coon et al. ..... 166/115
5,316,084 A 5/1994 Murray et al. ..... 166/332
5,549,161 A 8/1996 Gomez et al. ..... 166/255.1
5,636,694 A 6/1997 Mireles, Jr. et al. ..... 166/381
5,678,633 A 10/1997 Constantine, Jr. ..... 166/319
2006/0243455 A1 * 11/2006 Telfer et al. ..... 166/386

* cited by examiner

*Primary Examiner*—David J Bagnell
*Assistant Examiner*—Yong-Suk Ro
(74) *Attorney, Agent, or Firm*—Shawn Hunter

(57) ABSTRACT

Systems and methods for opening and/or closing sliding sleeve valves while preventing significant stress upon and damage to the fluid seals that are disposed between the outer housing and the sleeve member elements of the valve. A shifting tool carries a latching device and a fluid closure portion with sacrificial seals. In operations the shifting tool is secured to the sleeve member with the latching device as the closure portion seals off across the fluid flow port of the sleeve member. The shifting tool is then moved to slide the sleeve member between open and closed positions.

20 Claims, 6 Drawing Sheets

HIGH DIFFERENTIAL SHIFTING TOOL

BACKGROUND OF THE INVENTION

1. Field of the Invention

The invention relates generally to methods and devices for operating siding sleeve devices used in subterranean wellbores and the like.

2. Description of the Related Art

Sliding sleeve valve devices are well known and widely used in downhole hydrocarbon production. Typically, these devices are made up of an outer tubular housing that defines an axial flowbore within. One or more radial fluid transmission ports are disposed through the outer housing. The outer tubular housing contains an inner sleeve member that is shiftable (typically axially) within the housing. The inner sleeve member also presents a radial fluid port through its body, which is selectively aligned with the fluid transmission port (s) in the housing as the sleeve is shifted within the housing. Typically also, there are annular seal rings located on either axial side of the fluid transmission port(s) to prevent fluid from flowing between the housing and sleeve member.

Operational problems arise where there is a significant pressure differential between the interior flowbore and the surrounding wellbore. If this situation exists when the sleeve valve is being moved from a closed to an open position, or an open to a closed position, the seal rings are especially vulnerable to high pressure fluids passing through the aligned fluid ports. As the valve fluid ports are slidingly moved with respect to each other, there is a point at which the port are partially aligned and fluid is forced through a very small area opening. The differential fluid pressure placed upon the seal rings at this point is quite high. The seal rings can be blown out or otherwise damaged during the process of opening or closing the sleeve valve. Damage to the seal rings can seriously degrade or eliminate the ability of the sleeve valve to close off fluid flow into or out of the flowbore.

At times, conditions develop within the wellbore wherein a sleeve valve must be opened or closed under differential pressure situations that are much greater than originally planned. A valve that is designed to open against a differential fluid pressure of, for example, 1,500 psi may be moved into a lower portion of the wellbore wherein differential pressures exceed 5,000 psi. In such a situation, operating the valve between open and closed positions would be inadvisable and likely destroy the ability of the valve to function properly thereafter.

The present invention addresses the problems of the prior art.

SUMMARY OF THE INVENTION

The invention provides devices and methods for opening and/or closing a sliding sleeve valve in order to prevent significant stress upon and damage to the fluid seals that are disposed between the outer housing and the sleeve member elements of the valve Preferred embodiments of the invention feature a shifting tool which carries a latching device and a fluid closure portion with sacrificial seals. In operation, the shifting tool is secured to the sleeve member with the latching device as the closure portion seals off across the fluid flow port of the sleeve member. The shifting tool is then moved to slide the sleeve member between open and closed positions. The shifting tool is then released from the sleeve member and the closure portion is removed from sealing contact with the fluid port of the sleeve member. The fluid seals between the housing and the sleeve member are protected since the rush of fluid associated with the release or capture of differential pressure will be diverted to the sacrificial seals.

In one preferred embodiment, the latching mechanism includes one or more collet fingers with a latching profile that is releasably securable to a matching profile on the sleeve member. When the collet fingers become affixed to the sleeve member, the closure portion covers the fluid port of the sleeve member and seals against fluid flow therethrough.

In a further preferred embodiment, the shifting tool is actuated by hydraulic pressure to cause the shifting tool to latch the shifting tool to the sliding sleeve member with latching keys. In addition, the hydraulic pressure actively creates a fluid seal between the shifting tool and the sleeve member to block off the inner flow port associated with the sleeve member. A release of hydraulic pressure both releases the latching arrangement and unseals the closure portion from the sleeve member.

In a further embodiment, the shifting tool includes a locking mechanism wherein a releasable ratchet-type locking member helps to secure the latching key(s) to the sleeve member.

BRIEF DESCRIPTION OF THE DRAWINGS

The invention is best understood with reference to the following drawings, wherein like reference numerals denote like elements, and.

DETAILED DESCRIPTION OF THE PREFERRED EMBODIMENTS

Figure 1:
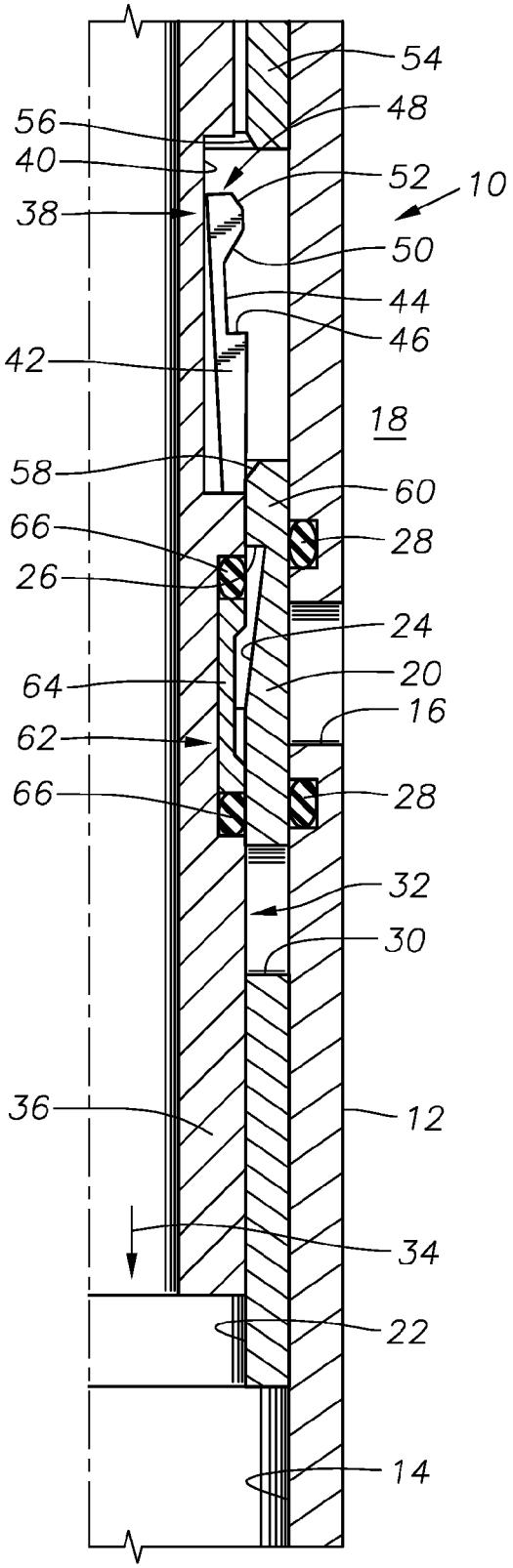
FIG. 1 is a side, one-quarter cross-sectional view of an exemplary sliding sleeve valve and shifting tool constructed in accordance with the present invention in a fully closed position.

FIG. 1 depicts an exemplary sliding sleeve valve 10 having an outer housing 12 that defines a central flowbore 14 along its length. The housing 12 of the sliding sleeve valve 10 is typically incorporated into a production tubing string of a type known in the art for hydrocarbon production and disposed within a hydrocarbon production wellbore. An outer radial fluid flow port 16 is disposed through the housing 12 to permit fluid communication between the annulus 18 surrounding the housing 12 and the flowbore 14. An interior sliding sleeve member 20 is disposed within the flowbore 14 of the housing 12. The sleeve member 20 is axially moveable within the flowbore 14 with respect to the housing 12. A central axial pathway 22 is defined within the sleeve member 20. It is noted that the upper axial end of the pathway 22 of the sleeve member 20 contains a radially enlarged recess 24 that provides a downwardly-facing stop shoulder 26.

Annular fluid seals 28 are located on each axial side of the outer radial fluid flow port 16 and are sandwiched between the sleeve member 20 and the housing 12. The seals 28 provide sealing between the sleeve member 20 and the housing 20.

An inner radial fluid port 30 is disposed through the sleeve member 20. In the configuration depicted in FIG. 1, the inner port 30 is not aligned with the outer radial fluid port 16. Because the inner port 30 is located below the lower annular seal 28, fluid can not be transmitted between the annulus 18 and the flowbore 14.

FIG. 1 also depicts a shifting tool, generally shown at 32, which is being disposed into the flowbore 14 and axial pathway 22, in the direction of arrow 34. The shifting tool 32 may be run into the production string that contains the housing 12 by wireline or by other suitable means known in the art. The shifting tool 32 includes a generally cylindrical tool body 36 which carries a latching and locating mechanism in the form of a latching profile 38. In the depicted embodiment, the latching profile 38 includes an annular reduced diameter cutaway portion or trough 40 and a set of collet fingers 42 that overlie the trough 40. The collet fingers 42 features a notch portion 44 with an upwardly directed stop ledge 46 defined at the lower end. A distal head portion 48 of each collet finger 42 features downwardly and outwardly facing glide face 50 and an upwardly and outwardly facing glide face 52.

The housing 12 carries a release shoulder 54 within the flowbore 14 above the sleeve member 20. The release shoulder 54 presents an inwardly and downwardly directed beveled edge 56 that is shaped to be generally complimentary to a slanted inwardly-directed face 58 at the upper end of the sleeve 20.

In exemplary operation, the sleeve valve 10 is initially in a closed configuration as depicted in FIG. 1 with the inner fluid port 30 not aligned with the outer fluid port 16 so as to block fluid transmission between the central flowbore 14 and the annulus 18. It is desired to move the sleeve valve 10 to an open position while protecting the seals 28 from wear resulting from movement of the sleeve member 20 with respect to the housing 12. In operation to move the sleeve member 20, the shifting tool 32 is disposed within the flowbore 14 and slid downwardly (i.e., in the direction of arrow 34). As the shifting tool 32 is moved down sufficiently far, as shown in FIG. 1, the presence of the shifting tool 32 will block fluid flow from passing through the inner fluid port 30.

Figure 2:
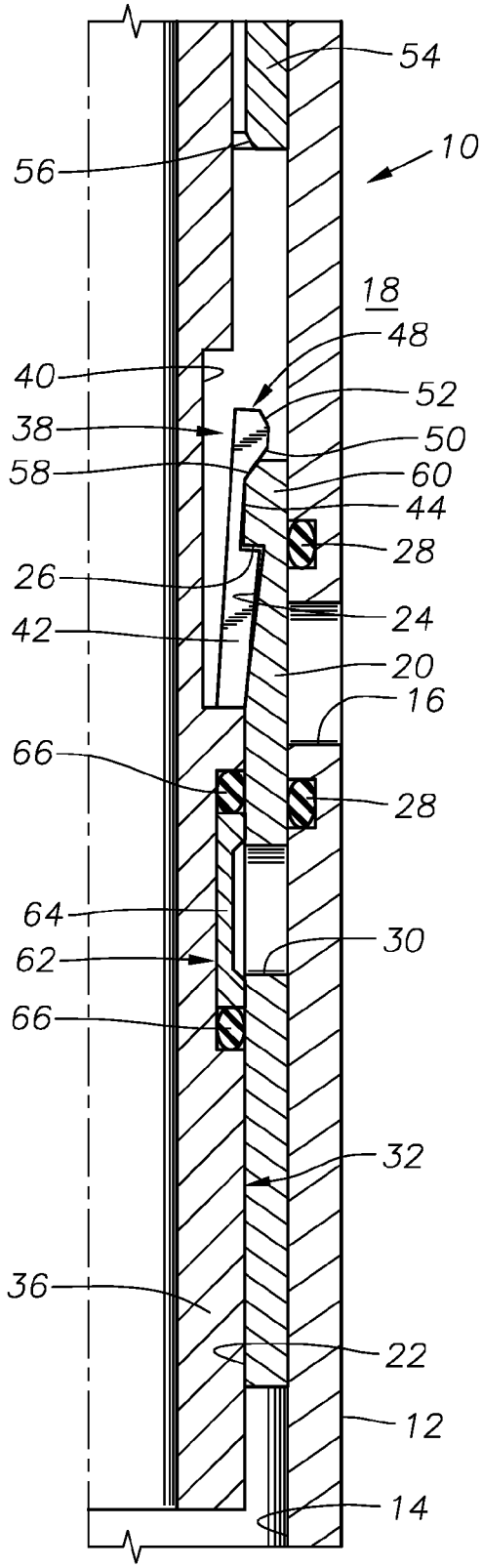
FIG. 2 is a side, one-quarter cross-sectional view of the exemplary sliding sleeve valve and shifting tool shown in FIG. 1, now the shifting tool engaged in preparation for opening the sleeve valve.

The shifting tool 32 is then secured to the sleeve member 20, as shown in FIG. 2, so that it can thereafter be used to open the sleeve valve 10. The shifting tool 32 becomes seated when the ledge 46 passes below the stop shoulder 26 of the sleeve member 20. The collet fingers 42 will expand radially outwardly due to shape memory to cause the upper end 60 of the sleeve member 20 to be captured by the notch 44 of each of the collet fingers 42. The collet fingers 42 snapping into engagement in this manner should provide an indication at surface that the shifting tool 32 has been secured or latched to the sleeve member 20 and that the sleeve member 20 may now be shifted within the housing 12. With this engagement, upward movement of the shifting tool 32 will cause the sleeve member 20 to move upwardly with respect to the surrounding housing 12.

When the shifting tool 32 is seated as shown in FIG. 2, a fluid closure portion 62 of the shifting tool 32 will block passage of fluid through the valve 10. The fluid closure portion 62 includes a blocking plate 64 and a pair of annular sacrificial fluid seals 66 that are located on both axial sides of the blocking plate 64. The blocking plate 64 covers the flow port 30 and the fluid seals 66 will create a seal against the interior surface of the axial pathway 22, thereby preventing fluid passing through the port 30 from flowing axially between the shifting tool 32 and the sleeve member 20.

Figure 3:
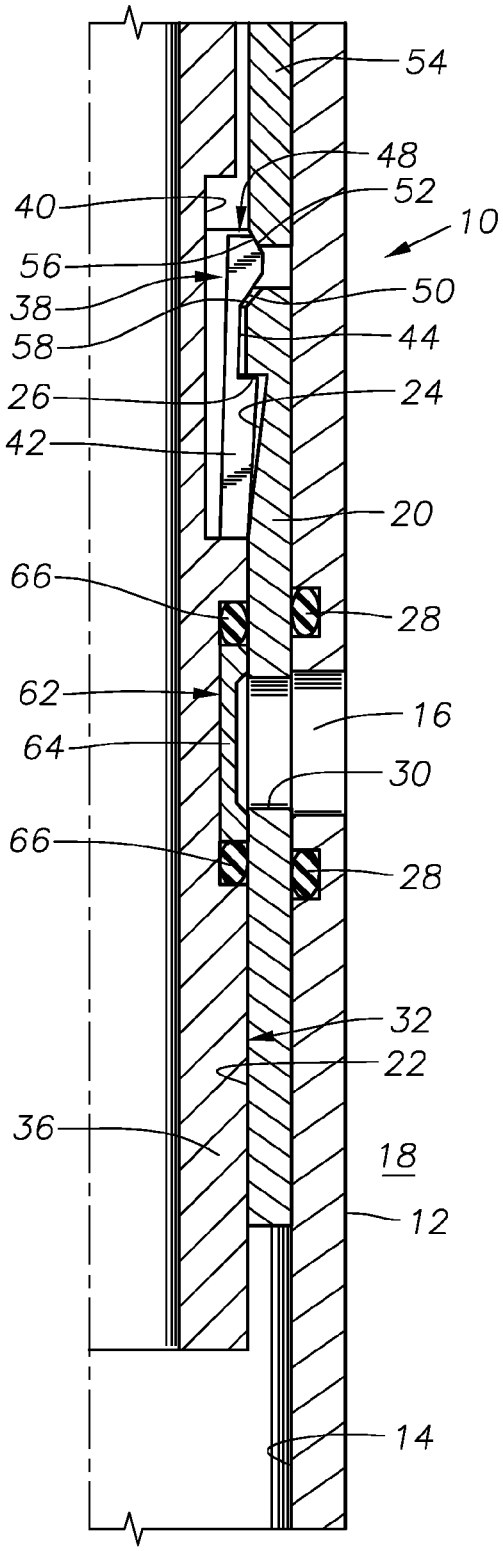
FIG. 3 is a side, one-quarter cross-sectional view of the exemplary sleeve valve and shifting tool now with the sleeve having been moved by the shifting tool to an open position.

FIG. 3 depicts the shifting tool 32 now having moved the sleeve member 20 to an open position such that the inner fluid flow port 30 is aligned with the outer fluid flow port 16. The sleeve member 20 has been shifted upwardly until the inner port 30 is located above the lower fluid seal 28, thereby allowing fluid passing through the outer port 16 to enter the inner port 30. However, passage of fluid through the valve 10 is still precluded by the closure portion 62 which covers the inner port 16. Because the inner port 30 is covered by the closure portion 62 during movement of the sleeve member 20 with respect to the housing 12, differential pressure placed upon the primary valve seals 28 is minimized during the opening operation.

Figure 4:
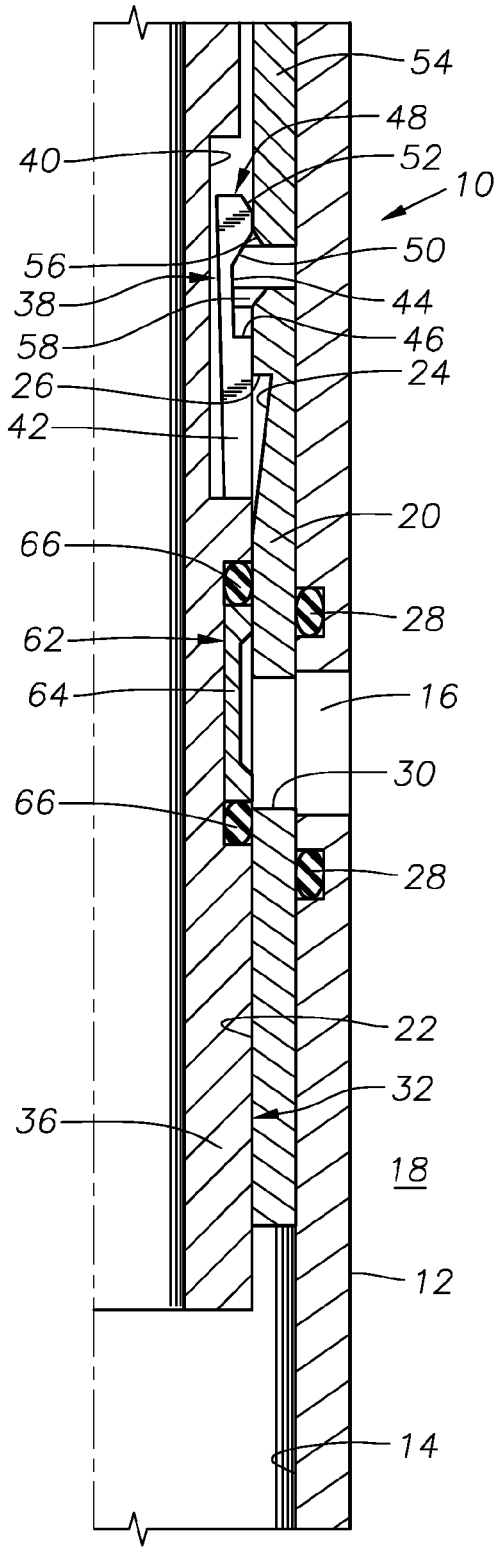
FIG. 4 is a side, one-quarter cross-sectional view of the exemplary sleeve valve and shifting tool shown in FIGS. 1-3, now with the shifting tool being released from the sliding sleeve valve.

FIGS. 3 and 4 depict release of the shifting tool from the sleeve member 20 following opening of the valve 10. The glide face 52 of each collet finger 42 contacts the beveled edge 56 of the release shoulder 54 and slides upon it, causing the collet fingers 42 to be deflected radially inwardly into the trough 40. This will release the shifting tool 32 from engagement with the sleeve member 20, and further upward pull upon the shifting tool 32 will withdraw the shifting tool 32 from the flowbore 14. When the shifting tool 32 is withdrawn from within the sleeve member 20, the closure portion 62 will no longer block fluid flow through the valve 10. It is noted that the shifting tool 32 could also be used to move the sleeve valve 10 from an open to a closed configuration.

Figure 5:
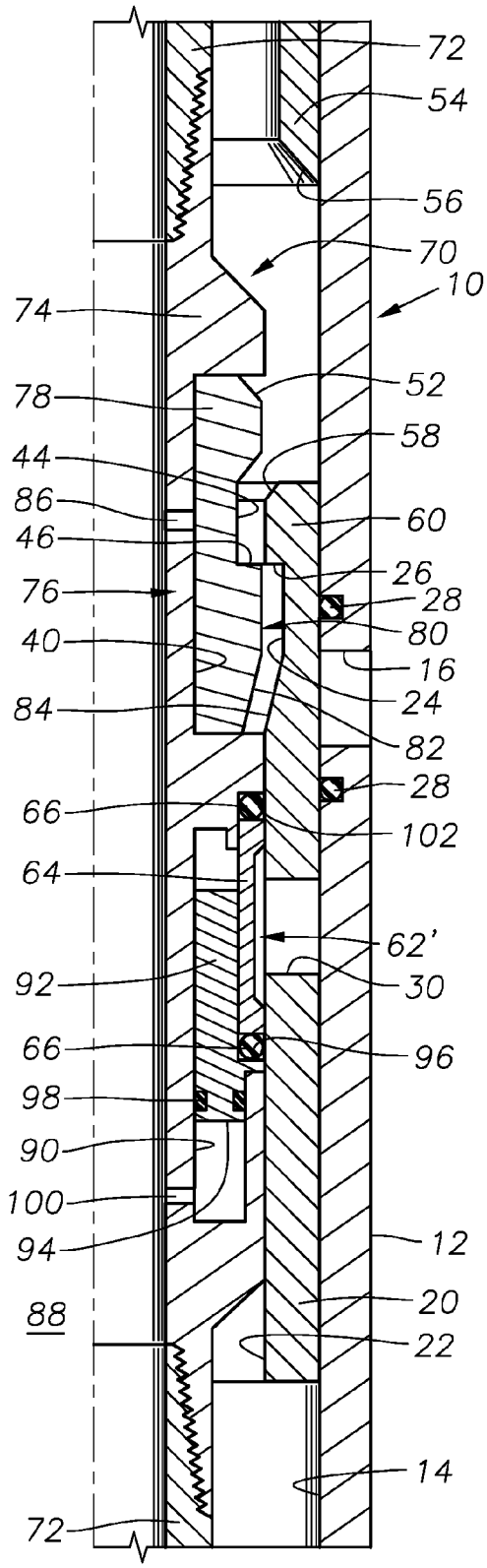
FIG. 5 is a side, one-quarter cross-sectional view of a sliding sleeve valve and an alternative shifting tool arrangement constructed in accordance with the present invention.
Figure 6:
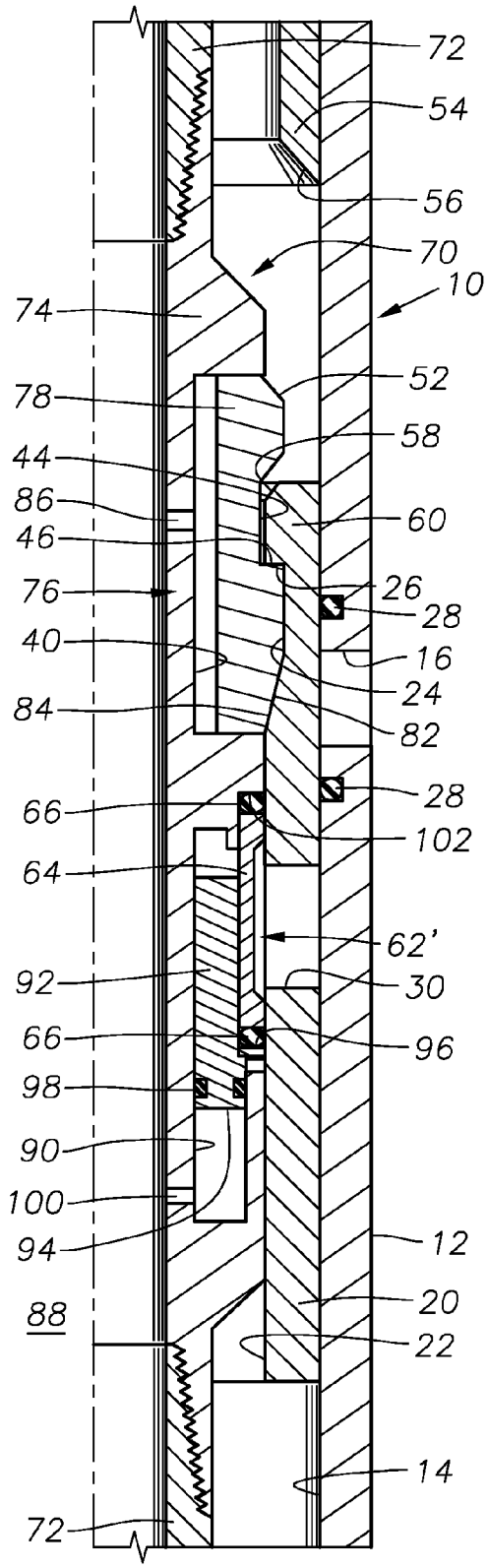
FIG. 6 is a side, one-quarter cross-sectional view of the sleeve valve and shifting tool depicted in FIG. 5, now with the shifting tool actuated to engage the sleeve member and actively seal the inner flow port.

FIGS. 5 and 6 illustrate an exemplary alternative sliding sleeve valve assembly and shifting tool 70 constructed in accordance with the present invention. This embodiment is particularly useful for use in coiled tubing production arrangements wherein the shifting tool 70 may be actuated using the power of hydraulic fluid pumped down the coiled tubing. The shifting tool 70 is shown affixed by threaded connections to coiled tubing portions 72. The sleeve valve assembly 10 is shown here in an initially closed position wherein the inner fluid flow port 30 is not aligned with the outer fluid flow port 16, thereby blocking fluid flow through the valve 10. In FIG. 5, however, the shifting tool 70 is already depicted in place with the fluid closure portion 62 adjacent the inner port 30, having been previously conveyed into the flowbore 14 via coiled tubing 72 in a manner well known in the art.

The shifting tool 70 includes a generally cylindrical housing 74 with a latching mechanism 76 and the fluid closure portion 62' housed within. The latching mechanism 76 includes the trough 40 with one or more keys 78 (one shown) moveably disposed therein. If desired, there may be a retaining cage (not shown) associated with the latching mechanism for loosely securing the keys 78 within the trough 40. The keys 78 are moveable radially outwardly (see FIG. 6 versus FIG. 5) with respect to the trough 40. Each of the keys 78 presents a latching profile 80 which includes the notch portion 44 and stop ledge 46. Each key 78 presents an outwardly and downwardly-facing glide face 82 that is shaped in a complimentary manner to ramp surface 84 on the sleeve member 20. Also, the upper end of each key 78 features an upwardly and outwardly-directed glide face 52. A first fluid transmission port 86 is disposed through the housing 74 so that fluid communication is provided between the trough 40 and the central flowbore 88 of the shifting tool 70. A flow of pressurized fluid from the flowbore 88 to the trough 40 will urge the keys 78 radially outwardly with respect to the housing 74 of the shifting tool 70.

The fluid closure portion 62' includes the blocking plate 64 and elastomeric fluid sealing elements 66. The closure portion 62' also features a piston chamber 90 located adjacent the plate 64 and sealing elements 66. A piston 92 is shiftably disposed within the chamber 90. The piston 92 presents a fluid pressure receiving end 94 and a compression end 96. An annular fluid seal 98 is provided between the piston 92 and the surrounding chamber 90. The compression end 96 adjoins one of the sealing elements 66. A second fluid communication port 100 extends through the housing 74 to the chamber 90.

FIG. 6 depicts the shifting too 70 now having been actuated using hydraulic pressure from within the central flowbore 88 to both secure the latching device 76 with the sleeve 20 and to energize the sealing elements 66 of the closure portion 62. In FIG. 6, fluid pressure has been increased within the coiled tubing 72 and the central flowbore 88 of the shifting tool 70. The increased fluid pressure is transmitted from the flowbore 88 through the first fluid transmission port 86 to the trough 40 and causes the key(s) 78 to be moved radially outwardly with respect to the housing 74 to cause the ledge 46 of each key 78 to slide beneath the stop face 26 of the sleeve member 20 as the upper end 60 of the sleeve member 20 slides into the notch 44. With this engagement, any upward movement of the shifting tool 70 with respect to the valve housing 12 will also move the sleeve member 20 axially upwardly with respect to the housing 12.

Increased fluid pressure within the flow,bore 88 will also be transmitted through the second fluid transmission port 100 into the piston chamber 90. The increased fluid pressure within the chamber 90 bears against the pressure receiving end 94 and causes the piston 92 to shift within the chamber 90 and urges the compression end 96 against the adjacent elastomeric sealing element 66. Both sealing elements 66 and the blocking plate 64 are compressed against a bulkhead 102 in the housing 74. As these components are axially compressed against the bulkhead 102, the sealing elements 66 are extruded radially outwardly and into sealing contact with the inner surface 22 of the sleeve member 22 on both axial sides of the fluid pod 30. As a result, the inner fluid port 30 is actively sealed off Once the shifting tool 70 is affixed to the sleeve 20 and the port 30 actively sealed off, the coiled tubing 72 and shifting tool 70 may be lifted to shift the sleeve member 20 axially upwardly with respect to the surrounding housing 12, as described previously. In this case, the shifting action will open the sleeve valve 10 by sliding the inner fluid flow port 30 axially upwardly above the lower fluid seal 28, thereby allowing fluid flow between the flowport 30 and the flowbore 14 of the valve housing 12. Sealing off the pod 30 prior to shifting the sleeve 20 is advantageous since the point of pressure transfer associated with the high pressure rush of fluid during opening is shifted radially inwardly from the outer seals 28 to the inner seals 66. The seals that are adversely affected by the increased differential fluid pressure during closing/opening of the valve 10 are the sacrificial seals 66. Because these seals are removed with the shifting tool 70, they can be easily replaced.

After opening the sleeve valve 10 the shifting tool 70 is released from the sleeve member 20 and removed from the flowbore 14 by pulling to coiled tubing out of the hole. To release the shifting tool 70, fluid pressure is reduced within the coiled tubing 72 and the central flowbore 88. The pressure reduction will cause the key(s) 78 to withdraw radially inwardly, thereby releasing the shifting tool 70 from engagement with the sleeve member 20. In addition, the piston end 96 no longer compresses the sealing members 66 of the closure portion 62, and the fluid seal across the inner fluid port 30 is released. If necessary to help release the key(s) from the sleeve member 20, the shifting tool 70 may be raised further upwardly with respect to the valve housing 12 so that the glide face 52 of the key(s) 78 contacts the beveled edge 56 of the shoulder 54, as previously described, to urge the key(s) 78 radially inwardly thereby releasing the shifting tool 70 from the sleeve 20

Figure 7:
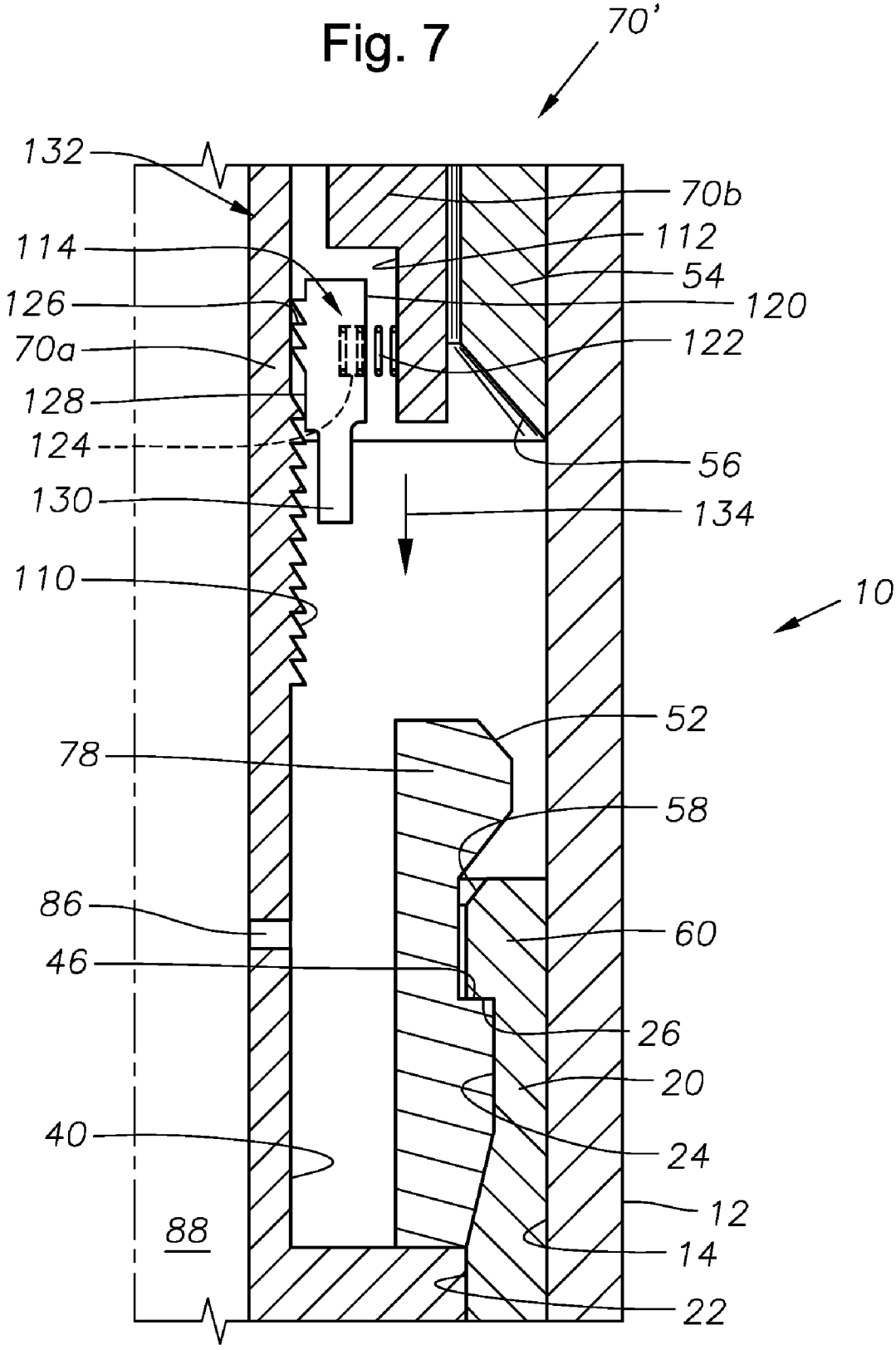
FIG. 7 is a side, one-quarter cross-sectional view of an exemplary releasable locking mechanism that could be used with the shifting tool and sleeve valve shown in FIGS. 5 and 6, wherein the locking mechanism in unlocked.

FIG. 7 illustrates an alternative exemplary release mechanism that might be used with an arrangement of the type described with respect to the valve 10 and shifting tool 70 above and described with respect to FIGS. 5-6. Except where specifically identified otherwise, construction and operation of the sleeve valve 10 and shifting tool 32 is identical to those of previously described embodiments. First, the shifting tool 70, is made up of two tool components **70*a* and 70*b*, which are axially moveable with respect to one another. The radially inner component 70*a* includes a one-way toothed ratchet surface 110**, of a type known in the art for allowing one-way ratcheting type movement along a surface.

Figure 10:
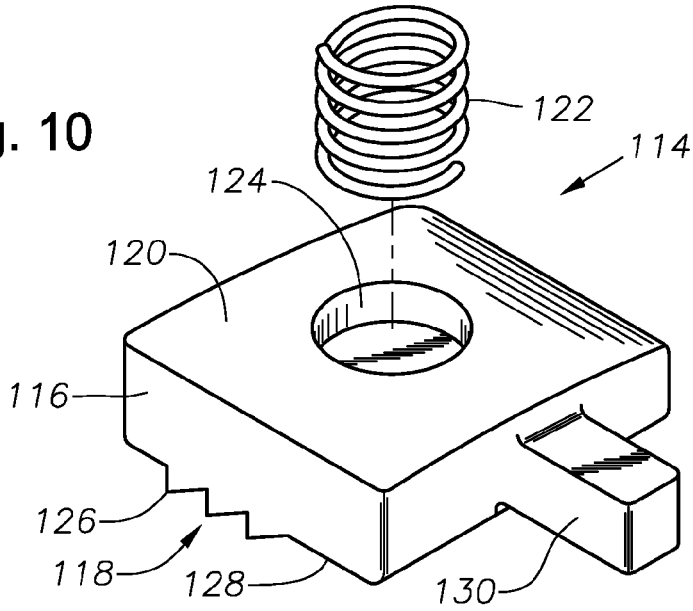
FIG. 10 is an isometric view of components of the locking mechanism of FIGS. 7-9, shown apart from the rest of the device.

The outer component **70*b* includes a pocket 112 that retains a releasable locking member 114. The locking member 114 is shown apart from other components of the shifting tool 70 in FIG. 10. The locking member 114 includes a central body 116 with an inner engagement surface 118 and an opposite outer surface 120. A compression spring 122 is located within a depression 124 on the outer surface 120. The spring 122 is in compressive engagement with the pocket 112. The inner engagement surface 118 of the locking member 114 includes a toothed surface portion 126 and a pivot portion 128 that is substantially smooth. A release tab 130 extends from one end of the locking member 114**.

Figure 8:
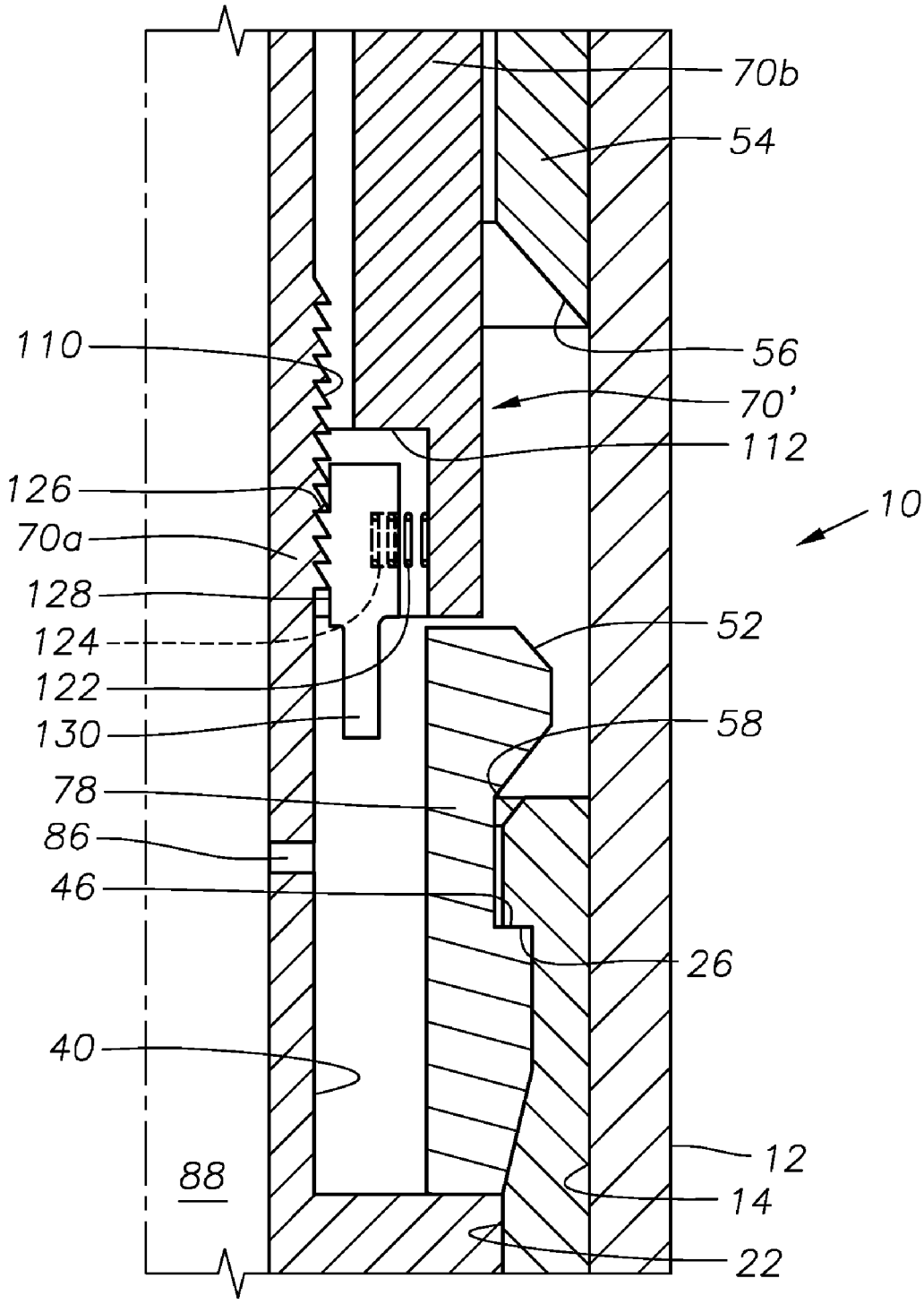
FIG. 8 is a side, one-quarter cross-sectional view of the locking mechanism shown in FIG. 7, now in a locked configuration.
Figure 9:
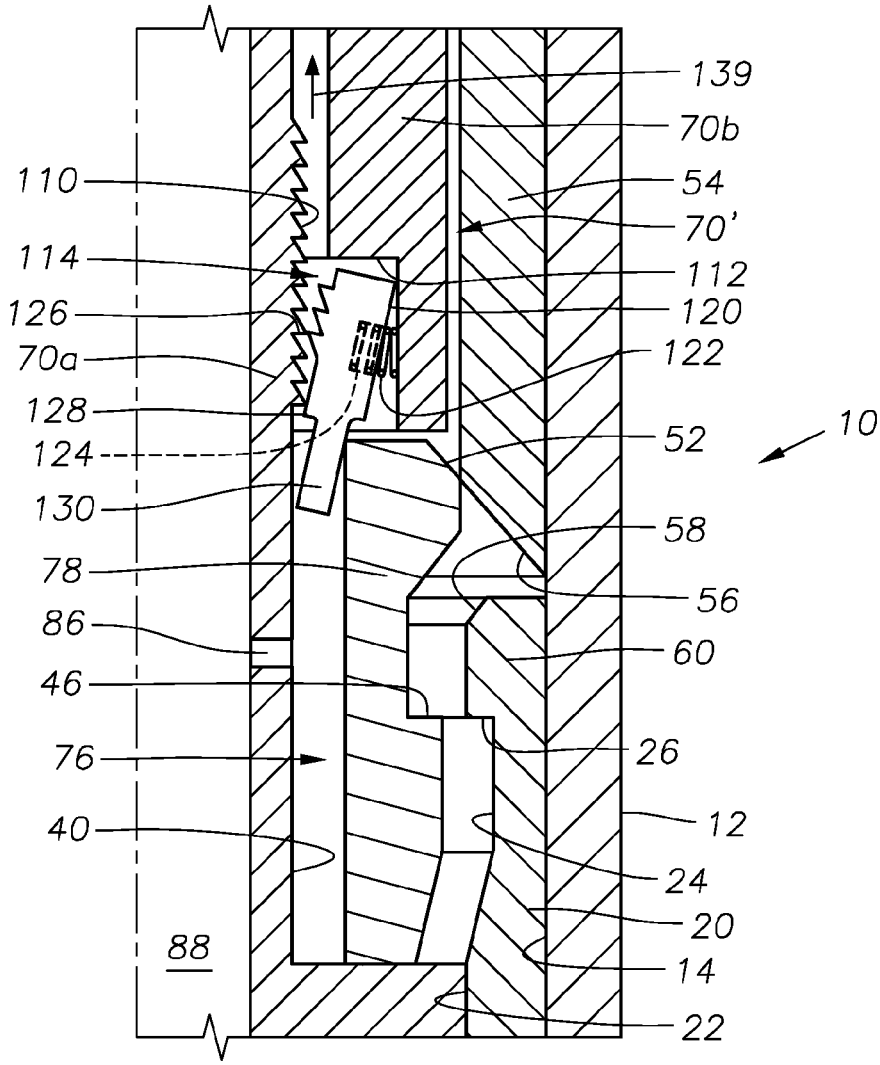
FIG. 9 is a side, one-quarter cross-sectional view of the locking mechanism shown in FIGS. 7-8, now in a released position.

FIG. 7 illustrates the shifting tool 70' now with the latching key(s) 78 having been urged radially outwardly via increased hydraulic fluid pressure through port 86 and into latching engagement with the sleeve 20. At this point, the shifting tool 70' is latched to the sleeve 20. However, it is further desired to secure the key(s) 78 in latching engagement so that the key(s) 78 is/are not inadvertently released. Therefore a locking mechanism, generally indicated at 132 is used to lock the key(s) 78 into place. To actuate is the locking mechanism 132, the radially outer component **70*b* of the shifting tool 70' is moved axially downwardly, in the direction of arrow 134 in FIG. 7, with respect to the inner component 70*a*. Such manipulation may be accomplished by means of wireline-run shifting tools, of a type known in the art. Downward movement of the outer component 70*b* will move the locking member 114 along the ratchet surface 110 to a point as illustrated in FIG. 8, so that the tab 130 extends beneath the key(s) 78 and blocks the key(s) 78 from inward radial movement. The interrelation of the ratchet surface 110 and the toothed surface portion 126 of the locking member 114 ensures that the locking member 114 does not move axially outwardly from the key(s) 78. In addition, the outer component 70*b* is secured axially with respect to the inner component 70*a***.

Following the latching attachment of the shifting tool 70 to the sleeve member 20 and engagement of the locking mechanism 132, as described, the shifting tool 70' may be moved axially upwardly with respect to the housing 12 to shift the sleeve member 20 between closed and open positions, as described earlier. The shifting tool 70' is released from latching connection with the sleeve member 20 by releasing fluid pressure within the central flowbore 88 and moving the shifting tool 70' axially upwardly with respect to the housing 12 until the glide face 52 of the key(s) 78 contacts the beveled edge 56 of the shoulder 54. This sliding contact forces the key(s) 78 radially inwardly to press inwardly upon the release tab 130. The locking member 114 is tilted upon its pivot portion 128 to bring the toothed surface portion 126 out of ratchet-like engagement with the toothed ratchet surface 110. As a result, the outer component 70*b* is freed to move axially upwardly with respect to the inner component 70*a*, in the direction of arrow 136. This movement will retract the release tab 130 of the locking member 114 from beneath the key(s) 78 and allow the key(s) 78 to retract back into the trough 40 Thereafter, the shifting tool 70' is released from engagement with the sleeve member 20 and may be withdrawn from the flowbore 14.

The sliding sleeve valve 10l together with the shifting too 32, 70 or 70', may be thought of collectively as a sliding sleeve valve assembly. It should be understood that systems and methods of various embodiments of the invention provide protection to the fluid seals 28 which are located between the housing 12 and the sleeve member 20 since the point of differential pressure change is moved radially inwardly and upon the sacrificial seals 66. The differential pressure change associated with either opening or closing off the inner fluid port 30 occurs when the closure portion 62 is placed over or removed from over the port 30 rather than occurring when the sleeve 20 is shifted with respect to the housing 12. The systems and methods provided by the present invention thereby provide a new and unexpected benefit and result not present in previous shifting tools, Those of skill in the art will recognize that numerous modifications and changes may be made to the exemplary designs and embodiments described herein and that the invention is limited only by the claims that follow and any equivalents thereof.

What is claimed is:

1. A sliding sleeve valve assembly comprising:

a housing having a generally cylindrical housing body defining a flowbore, the housing having a first fluid flow port disposed through the body;

a sleeve member disposed within the flowbore, the sleeve member having a generally cylindrical body and a second fluid flow port disposed through the body, the sleeve member being shiftable within the housing between an open position wherein the second port is aligned with the first port and a closed position wherein the second port is not aligned with the first port; and a shifting tool for moving the sleeve member between the open and closed positions, the shifting tool having:

a latching mechanism for securing the shifting tool to the sleeve member; and a fluid closure portion to close the second port against fluid flow when the shifting tool is secured to the sleeve member.

2. The sliding sleeve valve assembly of claim 1 wherein the fluid closure portion comprises a blocking member to cover the second fluid flow port.

3. The sliding sleeve valve assembly of claim 1 wherein the fluid closure portion comprises a pair of fluid seals disposed on the fluid closure portion to form a fluid seal at each axial side of the second fluid flow port.

4. The sliding sleeve valve assembly of claim 3 wherein the seals of the fluid closure portion are energized by compression.

5. The sliding sleeve valve assembly of claim 4 wherein the seals are compressed by a piston that is hydraulically moved by fluid pressure.

6. The sliding sleeve valve assembly of claim 1 wherein the latching mechanism comprises a collet finger with a latching profile for selectively securing a portion of the sleeve member.

7. The sliding sleeve valve assembly of claim 1 wherein the latching mechanism comprises a latching key that is selectively moveable radially outwardly from the shifting tool and presents a latching profile for selectively engaging a portion of the sleeve member.

8. The sliding sleeve valve assembly of claim 7 further comprising a locking mechanism for selectively securing the latching mechanism in a latched position.

9. The sliding sleeve valve assembly of claim 7 wherein the latching member is selectively moved into and out of engagement by varying hydrostatic pressure within a central flowbore of the shifting tool.

10. A method of operating a sliding sleeve valve having a housing with a first radial fluid communication port and a sliding sleeve member with a second radial fluid communication port between open and closed positions, the method comprising the steps of:

closing the second radial fluid communication port against fluid flow therethrough;

shifting the sleeve member within the housing between open and closed positions while the second port is closed; and reopening the second radial fluid communication port to permit fluid flow therethrough.

11. The method of claim 10 wherein the step of closing the second radial fluid communication port further comprises:

securing a shifting tool to the sleeve member, the shifting tool having a fluid closure portion; and locating the fluid closure portion to close the second radial fluid communication port to block fluid flow therethrough as the shifting tool is secured to the sleeve member.

12. The method of claim 11 further comprising the step of compressing the fluid closure portion to energize fluid seals associated with the fluid closure portion to sealingly close the second radial fluid communication port.

13. The method of claim 10 wherein the step of closing the second radial fluid communication port against fluid flow further comprises disposing a blocking plates over the second fluid communication port.

14. The method of claim 10 wherein the step of closing the second radial fluid communication port against fluid flow further comprises disposing fluid seals proximate the second fluid communication port.

15. A sliding sleeve valve assembly comprising:

a housing having a generally cylindrical housing body defining a flowbore, the housing having a first fluid flow port disposed through the body;

a sleeve member disposed within the flowbore, the sleeve member having a generally cylindrical body and a second fluid flow port disposed through the body, the sleeve member being shiftable within the housing between an open position wherein the second port is aligned with the first port and a closed position wherein the second port is not aligned with the first port; and a shifting tool for moving the sleeve member between the open and closed positions, the shifting tool having:

a latching mechanism for securing the shifting tool to the sleeve member; and a fluid closure portion to close the second port against fluid flow when the shifting tool is secured to the sleeve member, the fluid closure portion including a pair of fluid seals to form a fluid seal at each axial side of the second fluid flow port.

16. The sliding sleeve valve assembly of claim 15 wherein the fluid closure portion further comprises a blocking member to cover the second fluid flow port.

17. The sliding sleeve valve assembly of claim 15 wherein the latching mechanism comprises a collet finger with a latching profile for selectively securing a portion of the sleeve member.

18. The sliding sleeve valve assembly of claim 15 wherein the latching mechanism comprises a latching key that is selectively moveable radially outwardly from the shifting tool and presents a latching profile for selectively engaging a portion of the sleeve member.

19. The sliding sleeve valve assembly of claim 18 further comprising a locking mechanism for selectively securing the latching mechanism in a latched position.

20. The sliding sleeve valve assembly of claim 18 wherein the latching member is selectively moved into and out of engagement by varying hydrostatic pressure within a central flowbore of the shifting tool.

* * * * *